US006131733A

United States Patent [19]

Ergle et al.

[11] Patent Number: 6,131,733

[45] Date of Patent: Oct. 17, 2000

[54] ATTACHABLE GOLF TEE HOLDING APPARATUS

[76] Inventors: Monty K. Ergle, 3200 SW. 34th Ave.; Edward F. Rutkoski, 2707 SW. 33rd Ave. #613, both of Ocala, Fla. 34474

[21] Appl. No.: 09/280,354

[22] Filed: Mar. 29, 1999

[51] Int. Cl.[7] ..... B65D 85/20

[52] U.S. Cl. ..... 206/315.1; 206/459.5; 383/22; 383/103

[58] Field of Search ..... 206/315.1, 315.2, 206/315.9; 220/661; 221/210, 225, 252, 255–257, 307, 309; 383/9, 10, 103, 105, 22

[56] References Cited

U.S. PATENT DOCUMENTS

| | | | |
|---|---|---|---|
| 1,973,819 | 9/1934 | Link | 206/315.5 |
| 2,112,339 | 3/1938 | Kasparek | 206/315.1 |
| 2,536,725 | 1/1951 | Cleveland | 206/315.1 |
| 3,062,422 | 11/1962 | Lord | 206/579 |
| 3,272,412 | 9/1966 | Antonious | 206/315.1 |
| 3,360,170 | 12/1967 | Scannell et al. . | |
| 4,730,728 | 3/1988 | Larkin | 206/315.1 |
| 5,176,253 | 1/1993 | Perrin et al. . | |
| 5,362,152 | 11/1994 | Flecher et al. | 383/103 |
| 5,632,496 | 5/1997 | Nelson . | |
| 5,695,064 | 12/1997 | Huang et al. | 383/9 |

*Primary Examiner*—Jim Foster
*Attorney, Agent, or Firm*—Carnes Cona & Dixon

[57] ABSTRACT

The present invention is a s holding device capable of being secured to a conventional golf bag. The holding device includes a holding body having an interior storage area for storing items, such as, and preferable, golf tees. The interior area is accessible via an opened top and the open top constitute a first removal mechanism. An attaching mechanism extends through said holding body for providing and enabling closure and accessibility to the interior storage area and for enabling attachment to a conventional golf bag. A second removal mechanism extends through the holding body and is configured for enabling items to be removed from the interior storage area singularly while preventing items to be inserted into the interior area.

20 Claims, 4 Drawing Sheets

ATTACHABLE GOLF TEE HOLDING APPARATUS

BACKGROUND OF THE INVENTION

1. Field of the Invention

The present invention relates generally to a golf tee holding apparatus and more particularly to a golf tee holding apparatus that is designed and configured to be removably secured to a conventional golf bag, and that will enable the release of one golf tee at a time.

2. Description of the Prior Art

Golfing can be an exciting and exhilarating sport, and one which requires patience, skill, concentration and accuracy. To successfully play the sport one must have the appropriate equipment and equipment which is accessible. Generally, golf bags are used to maintain the necessary clubs and can include accessory pockets on the exterior side, or even inside, so as to provide a means of maintaining other components, such as, but not limited to tees, balls, towel, umbrella, or the like, needed for completing a round of golf.

Typically, the accessory pockets are designed so that one must completely open the pocket in order to retrieve a particular item. An example of a golf bag is disclosed in U.S. Pat. No. 5,632,496, issued to Nelson. This conventional golf bag includes a side pocket having a pair of zippers. Each zipper, when opened, will expose a compartment that can be used for storage. Though a good method of maintaining items, this type of pocket provides a single means of removing items stored therein. This single means may be annoying when it is desirable to remove small items such as golf tees, golf balls or the like.

Other apparatus have been designed which address a particular need. For example, in U.S. Pat. No. 5,172,839 there is disclosed a golf tee holder. This apparatus includes a plurality of hollow sleeve members having a first end and a second end. The first ends are secured to each other and the second end receives the a single tee. Though substantially efficiently, the means of inserting tees can be time consuming. In addition the constant use may cause the pliable material to stretch and inherently not enable the hollow sleeve to successfully maintain the particular tee within the desired sleeve.

Yet another tee holding device is disclosed in U.S. Pat. No. 3,360,170 issued to Scannell et al. In this patent there is disclosed a hollow cylindrical body member fabricated from a resilient plastic material. Extending through the circumfercial sidewall of the hollow cylindrical body member is a plurality of openings. These openings are structured so as to receive tees, individually. This will allow for the user to insert and remove tees one-at-a-time. This device, like the previous ones, do address a particular need, but due to its compact placement of the tees it appears that one may accidentally remove a plurality of tees, as oppose to one. Insertion of the tees may be difficult to achieve, especially for the elderly and those with limited dexterity. Further, due to the resilient nature of the plastic, like with the previous patents, after continuous and constant use, the openings may inherently stretch, and prevent the apparatus from maintaining any tees, which is an undesired and unintended situation.

Accordingly, it is seen that there is a need for an apparatus designed and configured to maintain golf tees. The device should be structure so as to have a means of inserting the tees within the apparatus a second means for removing the tees, singularly, easily and efficiently. This device should be compact in size and optionally be adapted to be removably secured to a conventional golf bag. Ideally, this apparatus should also be structured so as to allow for removal of items on one surface and offer the option of placing an indicia, such as a logo, advertisement, in individual's initials, or the like on the opposite surface.

As will be seen, the present invention achieves its intended purposes, objectives and advantages, by accomplishing the needs as identified above, through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention is a holding device, ideally suited for use with golf tees, and optionally can be used with other golf equipment, such as balls, or the like. This holding device is designed and configured to be removably secured to a conventional golf bag so as to allow for a quick and efficient means of storing golf tees while still providing for a separate means of removing the particular tee expeditiously as well as singularly.

This holding device of the present invention is a pouch having a first surface secured to a second surface. A portion of the top area of the first and second surfaces are not secured, so as to provide for an inherent opening formed therein. This opening exposes and allows access to an interior area of the pouch that is used for storage of the particular item, such as golf tees. Located at this top portion of the first and second surfaces of the pouch is an attaching device that allows for the pouch to be removably secured to a conventional golf bag. Closing or opening the top portion of the pouch can be accomplished via the attaching device. Thereby, providing for the attaching device to enable attachment to a conventional bag, as well as provide a means of opening and closing the pouch when desired. In the preferred embodiment, utilizing the attaching device, also known as the closing/opening mechanism, will not require the removal of the pouch from the conventional golf bag.

To increase the interior storage area of the holding device, sidewalls and/or a bottom wall can be secured thereto. This will provide for a device that is still compact and non-bulky, by providing a final structure that is can be collapsed when not filled to capacity. The use of sidewalls and/or a bottom wall will inherently provide for a device that can easily be expanded when filled with a plurality of items, such as with tees, without being obtrusive to the user.

The first surface of the holding device of the present invention is fabricated from a material having a plurality of perforation. This material should possess some elastic characteristics. The second surface is fabricated from the same material as the first surface, or optionally, can be fabricated from a material different than the first surface. The material used for the first and second surfaces can include, but not be limited to, a woven or non-woven material, vinyl, leather, cotton, cotton blends, polyester, canvas, rubber, or the like.

To enable easy and efficient removal of the items located within the interior of the pouch, the perforations include a unique structure. This structure is such that removal can be instantaneous, continuous and without causing the perforations to stretch, tear or the like, regardless of the material used. Each perforation can include any geometric shape. In addition, each perforation can have a random shape so as to enhance the aesthetic appeal of the overall holding device. The combination of the material and the geometric shape will provide for an aperture or opening that will stretch to enable the item to be removed, while retaining its original shape after removal. The final structure of the perforation will enable singular, quick and easy removal of the item stored without marring or damaging any aspect of the pouch. This configuration will provide a final product that is long lasting and that will prevent tears or the like to occur with each perforation, thereby prolonging the life of each and every holding device.

To enhance the aesthetic appearance, marketing potential, or the like, of the holding device of the present invention, a logo, indicia, advertisement, or the like can be located on either the first surface, second surface, or optionally, both the first and second surfaces. The structure of the perforations is such that distortion will not be accomplished by having a logo, indicia or the like located thereon.

Using and operating the present invention is simple, easy, and extremely efficient. To utilize, the golfer opens the pouch via the opening/closing mechanism. The will widen the top portion to render the pouch to be in an opened position. Plurality of tees are inserted therein. The bag is closed and attached to the conventional bag via the attaching device. Once closed, the tees can be removed singularly via the perforation within the first surface.

Accordingly, it is the object of the present invention to provide for golf ball holding apparatus that will overcome the deficiencies, shortcomings, and drawbacks of prior pouches and methods thereof.

A further object of the present invention is to provide for a holding apparatus that is lightweight and simple in designed so as to provide for a holding device which can be beneficial within any type of environment.

Yet another object of the present invention is to provide for a holding apparatus designed and geared towards golf tees and that will enable adequate removal of tees singularly and efficiently, as well as provide a device that includes at least one surface which can include a logo, indicia or the like for personalizing, enhancing or providing a final product which is not only extremely useful, but is also aesthetically pleasing.

Still a further object of the present invention, to be specifically enumerated herein, is to provide a holder apparatus in accordance with the preceding objects and which will conform to conventional forms of manufacture, be of simple construction and easy to use so as to provide a device that would be economically feasible, long lasting and relatively trouble free in operation.

Although there have been many inventions related to a holding apparatus, particularly those which are designed to be removably secured to a golf bag, none of the inventions have become sufficiently compact, versatile, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1B:
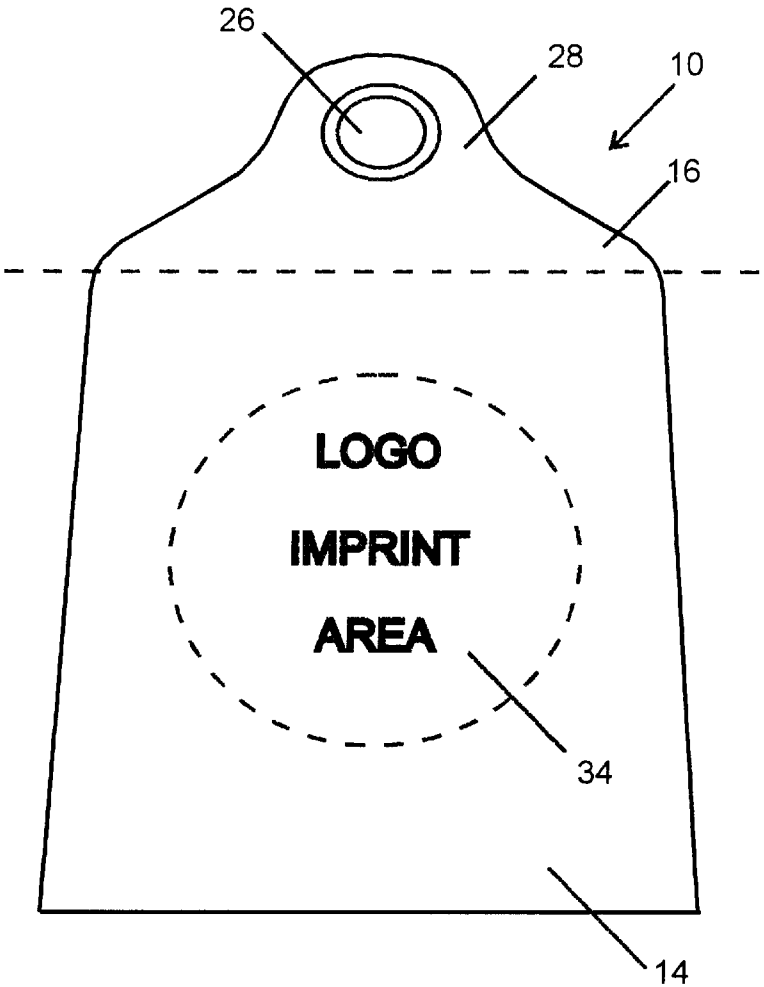
FIG. 1*b* is a front view of the second surface of the holding device of the present invention.

As seen in the drawings, in particular to FIGS. 1*a*–1*d* thereof, the present invention, a holding device, denoted by reference numeral 10, will be described. Shown is a holding device, ideally suited for use with golf tees, and optionally can be used with other golf equipment, such as balls, or the like, and enables removal of items stored therein singularly, efficiently and quickly.

Figure 1A:
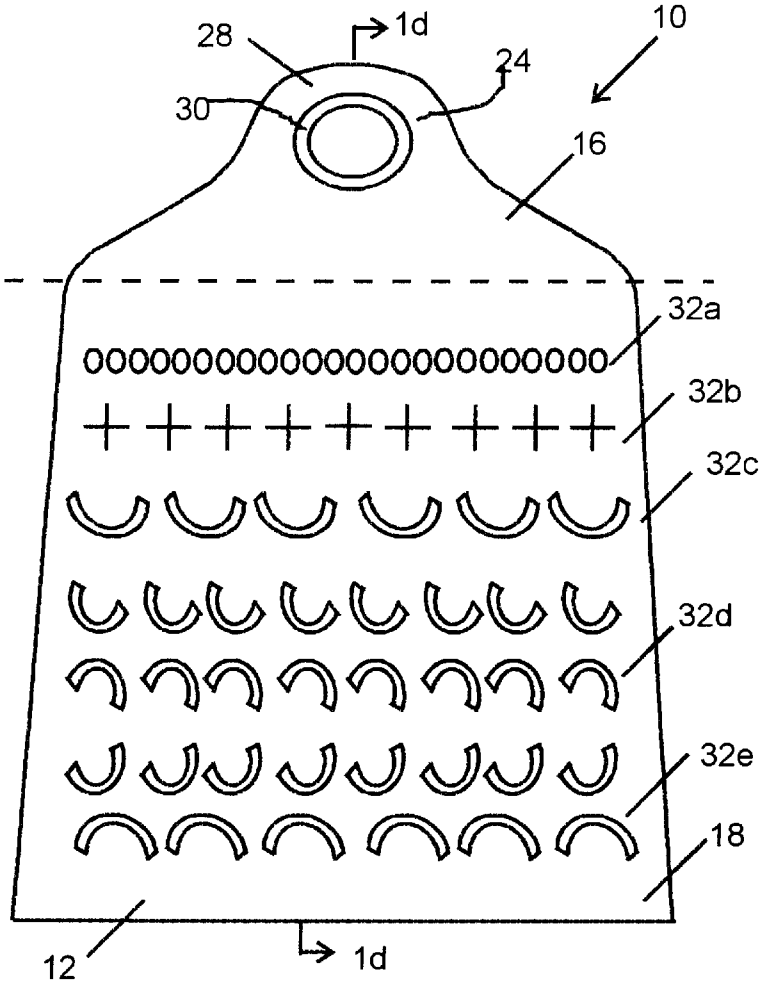
FIG. 1*a* is a front view of the first surface of the holding device of the present invention.
Figure 1C:
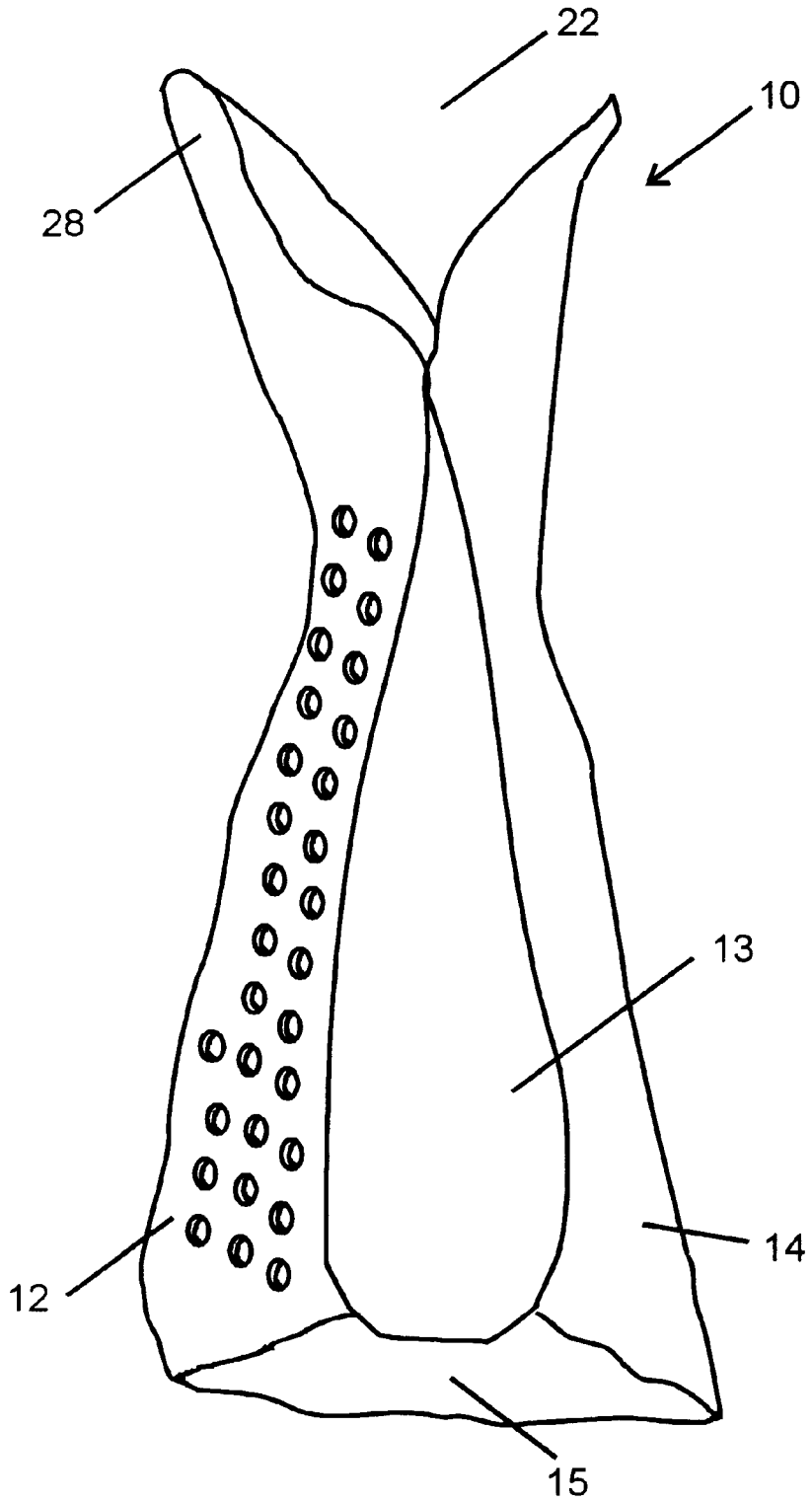
FIG. 1*c* is a side view of the holding device of the present invention, illustrating the optional side wall and bottom wall for expanding the space therein.
Figure 1D:
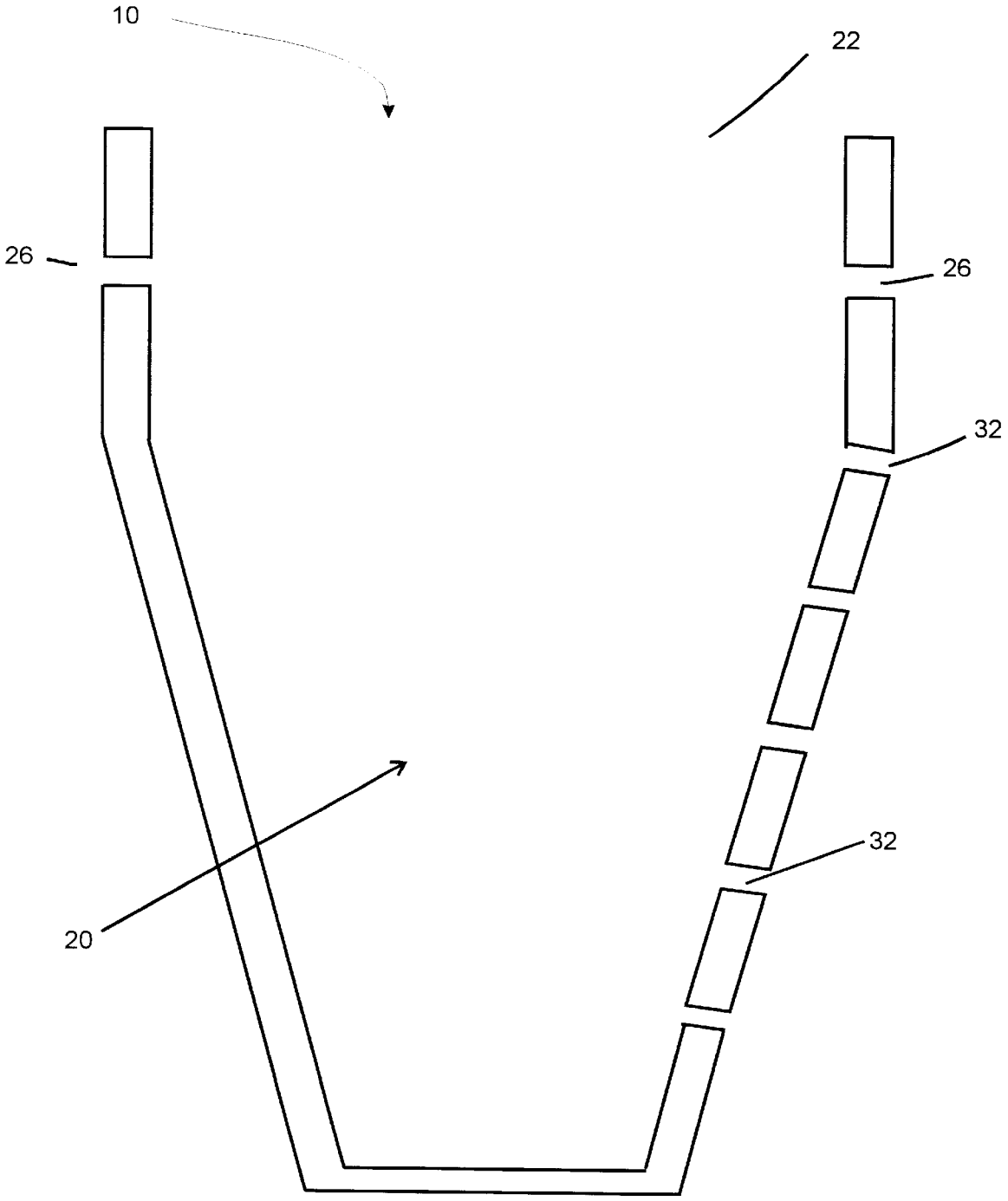
FIG. 1*d* is a cross-sectional view of the holding device of the present invention taken along lines 1*d*—1*d* of FIG. 1*a*.

The present invention is a pouch comprising a first side 12 partially secured to a second side 14. Each side includes an upper section 16 and a lower section 18 (separation of each section is shown via a dashed line, as seen in FIGS. 1*a* and 1*b*). Securement of the outer edge of first side 12 to the outer edge of the second side 14 occurs via the lower section 18. Securing the edges of the lower section 18 provides for an inherent interior area 20, as seen in FIGS. 1*c* and 1*d*, to be located within the first and second sides. This area 20 is a storage facility for the items that are to be stored, such as tees, balls or the like.

Since the top section 16 is not secured, an opening 22, shown in FIGS. 1*c* and 1*d*, is formed. The opening 22 exposes and allows access to the interior area 20 of the pouch. The top section further includes a receiving means 24, illustrated in FIGS. 1*a* and 1*b*, as an aperture 26. This aperture 26 will receive and maintain a securing device. The securing device is illustrated and discussed in further detail in FIG. 2. It is noted that this securing device will enable the holding device 10 of the present invention to be removably secured to a conventional golf bag.

To provide easy accessibility to the receiving means 24, the top portion 16 of each side can include an extension or flange portion 28. This extension or flange portion 28 extends upwardly from the top portion and decreases in width. Such a design provides easy availability to the attaching device and provides for the lower portion 18 to be non-obtrusive. Reinforcing material 30 can surround the receiving means for adding structural stability and support to the holding device 10 of the present invention.

It is noted that the overall shape of the holding device 10 can be altered in order to increase the interior storage area. This increase is seen in FIG. 1*c*. As shown the first side 12 can be secured to the second side 14 via extension wall 13. This extension wall 13 will innately increase the storage area by allowing the bag to expand when being filled with the desired item(s). Such an expansion will not sufficiently increase the final size of the holding device, yet will increase the desirability and usability of the final product.

Optionally, a lower extension wall or bottom wall 15 can be used to secure the first side 12 to the second side 14. This lower extension wall or bottom wall will operate and function in the same manner as the extension wall described and defined above. Alternatively, the extension wall 13 and lower extension wall 15 can be used simultaneously for optimizing the storage capabilities of the holding device 10. Thereby, providing the option of using: solely the first and second walls; the first wall, second wall, side extension wall; the first wall, second wall, bottom (lower) extension wall; or the first wall, second wall, side extension wall and bottom (lower) extension wall.

The final product is a device which can easily be collapsed when not use, thereby providing a non-bulky item, while providing a unit which can easily and efficiently expand when being filled with the desired items, such as with tees, without being obtrusive to the user.

As illustrated in FIGS. 1*a* and 1*d,* to enable easy and efficient removal of the items located within the interior 20 of the pouch, a plurality of perforations 32 extend through at least one side, and/or can also extend through the wall extension 13, if used, or the lower extension 15, if used, of the holding device 10. The perforations are designed such that removal can occur singularly and so that the perforations formed will not stretch, tear or rip, even during repeated use and regardless of the material utilized. As seen in FIG. 1*a,* the perforations 32 include a unique structure. Each perforation 32 includes a geometric structure, such as, but not limited to, crescent, star, oval, circular (see numeral 32*a*), rectangular, square, L-shape, x-shape, t-shape (see numeral 32*b*) or the like. These geometric shapes can be aligned horizontally (upwardly) 32*c,* vertically (sideways) 32*d,* angularly (at any angular displace, obtuse or acute) 32*d,* downwardly 32*e,* or any combination thereof, as seen in FIG. 1*a.* In operation, the user feels a tee within the bag and forces its front or point through the perforation. As it travels through the perforation, and increases in size, the perforation innately increases in size. Upon existing, the perforation returns to its original size. The perforations are sized so that the opening is smaller in surface area than the largest portion of the item stored therein. This decreased size will allow for the perforation to stretch, and thus enable the item stored therein to be removed singularly. The use of the geometric shapes will permit for the perforation to return to its original size and shape.

The first side, second side or both sides, as seen in FIG. 1*b,* can include a logo 34, indicia, advertisement, or the like to be secured thereto. This addition of a logo, indicia, advertisement or the like may enhance the aesthetic appearance or increase marketing potential of the holding device 10 of the present invention. It is noted that since the perforations are merely geometric slits, this structure is such that distortion will not be accomplished by having a logo, indicia or the like located thereon.

The first and second sides 12 and 14 respectively, and if used, the side extensions 13 and lower extension 15, are fabricated from any type of material. Preferably, the side or sides having the perforation should be constructed from a material possessing some resilient properties and elasticity. This will aid in the removal of the particular item, such as the removal of a tee. The first and second sides can be fabricated from the same material, or optionally, the first side can be fabricated from a material different than the second side. The material used for the first and second sides can include, but not be limited to, a woven or non-woven material, vinyl, leather, cotton, cotton blends, polyester, canvas, rubber, or the like.

Accordingly, as seen, the interior 20 of the holding device 10 of the present invention includes a first means for receiving tees. This first means is accomplished via the open top 22 of the device. Opening the top and exposing the interior area will enable a plurality of tees to be inserted therein and also allows for removal to occur, if desired. The perforations provide for a second means of removing the tees. This second means is separate from the first means and this second means prevents insertion to occur and requires removal to occur singularly. Such a design provides a final product that is efficient and quick in operation as well as being a device that is compact in size and easy to utilize.

Figure 2:
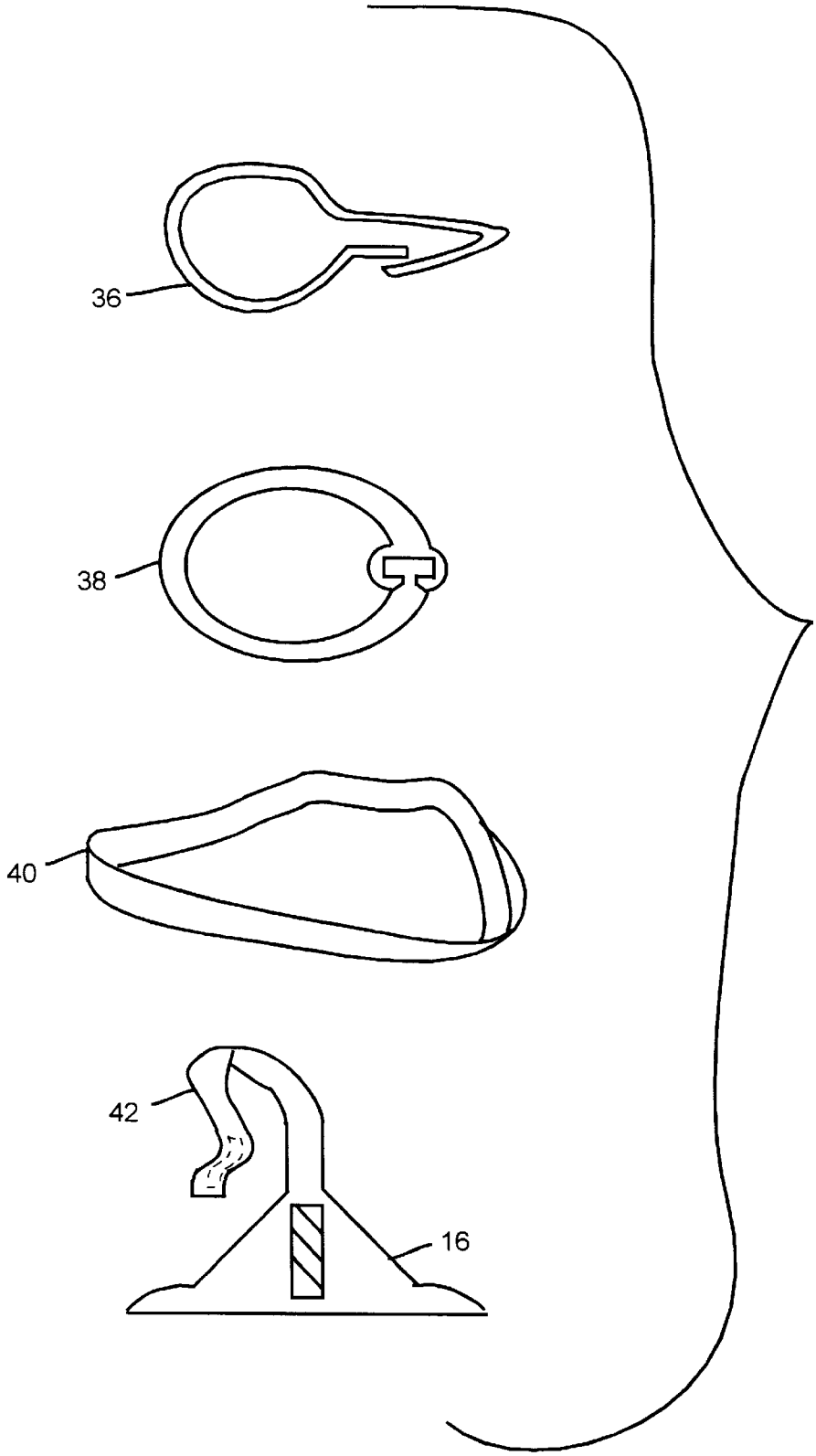
FIG. 2 are examples of the various attaching means used with the holding device of the present invention.

To secure the device 10 to a conventional bag an securing device is utilize. Examples of securing device that have been used to produce favorable results are illustrated in FIG. 2. It is to be understood, by those skilled in the art, that the securing device is a conventional feature, and can be reconfigured within the scope of the present invention, so as to provide for a final product that can easily be attached to a golf bag as well as offering a closure means. The securing device as illustrated in FIG. 2, offers a means of attaching the device to the conventional golf bag as well as provide a means of opening and/or closing the holding device. As seen, the securing device can include a conventional clip 36, known in the golfing industry as a golf towel clip, a snap-type conventional ring 38, a VELCRO strap 40, or a VELCRO strap 42 permanently affixed to the top portion of a singular side of the bag. The use of a permanently secured VELCRO strap provides for a one piece Velcro enclosure as well as provide for a final product consisting of a singular unit, as opposed to two portion, if used with other attaching device. The use of conventional attaching devices provides a device which is easy to manufacture and assembly. The final product is user friendly and versatile.

To utilize the device of the present invention the user merely opens the top of the bag to expose the interior area. This will widen the top portion to render the pouch to be in an opened position so as to allow for items to be inserted therein. Once filled with the desired item the bag is attached to the golf bag via the attaching devices, thereby providing for the top portion to be in a closed position. Once closed and secured, the items stored therein, such as tees, can be removed singularly via the perforations located on one of the sides.

While the invention has been particularly shown and described with reference to an embodiment thereof, it will be understood by those skilled in the art that various changes in form and detail may be made without departing from the spirit and scope of the invention.

We claim:

1. A holding device capable of being secured to a conventional golf bag, said holding device comprising:

a holding body having an interior storage area accessible via an opened top and said opened top for receiving items or removing items, said opened top constitutes a first removal mechanism and an insertion means;

a securing device is secured to said holding body;

said securing device enables said holding body to be removably secured to an object;

said securing device is a mechanical element that further enables said holding body to be sealed and closed so as to prevent access to said interior storage area by providing a mechanical means of closing and opening said holding body;

a second removal mechanism extends through said holding body;

said second removal mechanism is sized smaller than said first removal mechanism and is configured for enabling items to be stored within said interior storage area and when desired for removal, said items are removed from said interior storage area singularly, by a user, and prevents items to be inserted into said interior storage area via said second removal mechanism; and said holding body and said securing device are fabricated from a material enabling repeated use of said first removal mechanism, said second removal mechanism and said securing device without distorting or damaging said holding body, said securing device, said first removal mechanism or said second removal mechanism.

2. A holding device as in claim 1 wherein exteriorly located on said holding body is an indicia.

3. A holding device as in claim 1 wherein said second removal mechanism comprises a plurality of perforations.

4. A holding device as in claim 3 wherein said perforations have a geometric shape so as to enable singular removal and prevention distortion of said perforation.

5. A holding device as in claim 1 wherein said holding body comprises a first side and a second side, said first side and said second side each include an upper section and a lower section, said lower section of said first side is secured to said lower section of said second side and said first side includes said second removal mechanism.

6. A holding device as in claim 5 wherein said second side includes said second removal mechanism.

7. A holding device as in claim 5 wherein exteriorly located on said second side is an indicia.

8. A holding device as in claim 1 wherein said securing device comprises an aperture located within said holding body and a securing mechanism, said securing mechanism extends through said aperture for securing said holding body to said conventional golf bag and provides for a closure/opening mechanism for said opened top.

9. A holding device as in claim 8 wherein said aperture is reinforced for added structural stability.

10. A holding device as in claim 1 wherein said holding body comprises a first side and a second side, said first side and said second side each include a lower section, said lower section of said first side is secured to said lower section of said second side via extension walls, so as to provide for opposite outer ends of the extension wall to be secured to each side.

11. A holding device as in claim 10 wherein said lower section of said first side includes said second removal mechanism.

12. A holding device as in claim 10 wherein said second side includes said second removal mechanism.

13. A holding device as in claim 11 wherein exteriorly located on said second side is an indicia.

14. A holding device as in claim 10 wherein a bottom wall secures a bottom of said first side to said second side and also secures said lower edge of said extension wall to said lower edge of said second extension wall, so as to provide a holding device having five walls, including said first side, said second side, two extensions, and said bottom wall.

15. A holding device as in claim 14 wherein exteriorly located on said holding body is an indicia located.

16. A holding device as in claim 14 wherein said second removal mechanism comprises a plurality of perforations.

17. A holding device as in claim 1 wherein a lower bottom wall couples a lower edge of said first side to a lower edge of said second side, outer edges of said first side is coupled to outer edges of said second side.

18. A holding device as in claims 17 wherein exteriorly located on said holding body is an indicia located.

19. A holding device as in claim 17 wherein said second removal mechanism comprises a plurality of perforations.

20. A holding device capable of being secured to a conventional golf bag, said holding device comprising:

a holding body having an interior storage area accessible via an opened top and said open top constitutes a first removal mechanism;

said interior storage area is adapted to receive and maintain a plurality of golf tees;

a securing device extends through said holding body;

said securing device enables said holding body to be removably secured to a conventional golf bag;

said securing device is a mechanical element that further enables said holding body to be sealed and closed so as to prevent access to said interior storage area by providing a mechanical means of closing and opening said holding body;

a second removal mechanism extends through said holding body; and said second removal mechanism is sized smaller than said first removal mechanism and is configured to enable said plurality of golf tees to be removed singularly from said interior storage area via said second removal mechanism and said securing device prevents removal said plurality of golf tees from said first removal mechanism.

* * * * *